US011124213B2

(12) United States Patent
Schmidt et al.

(10) Patent No.: US 11,124,213 B2
(45) Date of Patent: Sep. 21, 2021

(54) METHOD FOR SECURING A LEVEL CROSSING, AND STATIONARY CONTROL DEVICE FOR A TRAIN CONTROL SYSTEM

(71) Applicant: SIEMENS MOBILITY GMBH, Munich (DE)

(72) Inventors: Thomas Schmidt, Braunschweig (DE); Jens-Harro Oechsner, Denkte ot Neindorf (DE)

(73) Assignee: Siemens Mobility GmbH, Munich (DE)

( * ) Notice: Subject to any disclaimer, the term of this patent is extended or adjusted under 35 U.S.C. 154(b) by 380 days.

(21) Appl. No.: 16/307,171

(22) PCT Filed: Jun. 1, 2017

(86) PCT No.: PCT/EP2017/063262

§ 371 (c)(1),
(2) Date: Dec. 5, 2018

(87) PCT Pub. No.: WO2018/001673

PCT Pub. Date: Jan. 4, 2018

(65) Prior Publication Data

US 2019/0144024 A1 May 16, 2019

(30) Foreign Application Priority Data

Jun. 27, 2016 (DE) ..... 102016211481.6

(51) Int. Cl.
*B61L 27/00* (2006.01)
*B61L 25/02* (2006.01)
(Continued)

(52) U.S. Cl.
CPC ..... *B61L 27/0038* (2013.01); *B61L 25/021* (2013.01); *B61L 29/22* (2013.01); *B61L 29/32* (2013.01); *B61L 2027/0044* (2013.01)

(58) Field of Classification Search
CPC .... B61L 27/0038; B61L 25/021; B61L 29/22; B61L 29/32; B61L 2027/0044
See application file for complete search history.

(56) References Cited

U.S. PATENT DOCUMENTS 8,870,126 B2 * 10/2014 Bock ..... B61L 29/00 246/124
9,493,176 B2 * 11/2016 Busse ..... B61L 29/30
(Continued)

FOREIGN PATENT DOCUMENTS

DE 19529374 A1 2/1997
DE 10227046 C1 7/2003
(Continued)

*Primary Examiner* — Jason C Smith
(74) *Attorney, Agent, or Firm* — Laurence A. Greenberg; Werner H. Stemer; Ralph E. Locher

(57) ABSTRACT

A method for securing a level crossing permits timely securing of the level crossing and is particularly effective and reliable. The method proceeds in such a way that vehicle data are received from a track-bound vehicle approaching the level crossing by a stationary control device of a train control system. The vehicle data include at least the current position and the current speed of the track-bound vehicle. A strike-in point is determined on the basis of the received vehicle data and route data including at least the location of the level crossing. Securing of the level crossing is triggered when the strike-in point is reached. A stationary control device for a train control system and an arrangement having such a stationary control device are also provided.

17 Claims, 2 Drawing Sheets

(51) Int. Cl.
*B61L 29/22* (2006.01)
*B61L 29/32* (2006.01)

(56) References Cited

U.S. PATENT DOCUMENTS

| | | | | |
|---|---|---|---|---|
| 2014/0367526 | A1* | 12/2014 | Steffen, II | B61L 25/025 246/126 |
| 2019/0144024 | A1* | 5/2019 | Schmidt | B61L 27/0038 246/115 |

FOREIGN PATENT DOCUMENTS

| | | | | |
|---|---|---|---|---|
| DE | 102007022837 | A1 | 11/2008 | |
| DE | 102009019302 | A1 | 10/2010 | |
| DE | 102011079186 | A1 | 1/2013 | |
| DE | 102013020523 | A1 | 6/2015 | |
| EP | 1022208 | A2 * | 7/2000 | B61L 29/24 |
| EP | 1022208 | A2 | 7/2000 | |
| JP | 2011105117 | A * | 6/2011 | |
| JP | 2011105117 | A | 6/2011 | |

* cited by examiner

METHOD FOR SECURING A LEVEL CROSSING, AND STATIONARY CONTROL DEVICE FOR A TRAIN CONTROL SYSTEM

BACKGROUND OF THE INVENTION

Field of the Invention

In real-world scenarios, optimizing closure times of level crossings is extremely important in the operation of track-bound vehicles, which may include for example rail vehicles, track-guided vehicles with rubber tires or magnetic levitation trains. Thus, in the event that the route or track system traveled by the track-bound vehicles crosses other traffic routes, in particular roads, there exists on the one hand the requirement that the corresponding crossing zones are reliably secured, i.e. protected and made safe, by means of level crossings. It is to be ensured in particular in this regard that the level crossing is secured in good time ahead of the arrival of the respective track-bound vehicle and that in the event of problems in securing the level crossing the respective track-bound vehicle can be brought to a stop before reaching the level crossing. On the other hand it is also necessary to minimize the impact on the crossing traffic, i.e. road traffic for example, by ensuring that the level crossing is secured for no longer than necessary. A corresponding securing of the level crossing can be accomplished for example by means of a barrier or a number of barriers. It is furthermore also possible for example to secure the level crossing simply by means of a corresponding signaling arrangement indicating that passing over the level crossing is prohibited. Such a signaling arrangement may be a traffic light signal, for example. In addition, other devices and methods for securing level crossings are also known and may also be combined with one another if necessary. Thus, it is possible for example to secure a level crossing by means of barriers and at the same time, or also in particular prior to the lowering of the barriers, to alert approaching traffic by means of a corresponding traffic light signal and/or an audible warning signal.

SUMMARY OF THE INVENTION

The object underlying the present invention is to disclose a method for securing a level crossing, which method permits timely securing of the respective level crossing and at the same time is particularly effective and reliable.

This object is achieved according to the invention by means of a method for securing a level crossing, wherein vehicle data are received by a stationary control device of a train control system from a track-bound vehicle approaching the level crossing, said vehicle data comprising at least the current position and the current speed of the track-bound vehicle, a switch-on point, hereinafter referred to as a "strike-in point", is determined taking into account the received vehicle data as well as route data comprising at least the location of the level crossing, and securing of the level crossing is triggered when the strike-in point is reached.

The inventive method for securing a level crossing is characterized firstly in that its method steps are performed by a stationary control device of a train control system. The term "stationary" in this context signifies that the control device in question is arranged at a fixed location outside of the track-bound vehicle. The stationary control device of the train control system may in this case be located at the side of the track, i.e. in the region of or in proximity to the route traveled by the track-bound vehicles, or alternatively be arranged at an arbitrary distance from the respective route.

According to the first step of the inventive method, vehicle data are received by the stationary control device of the train control system from a track-bound vehicle approaching the level crossing, said vehicle data comprising at least the current position and the current speed of the track-bound vehicle. The respective current position and the respective current speed may in this case be determined on the part of the respective track-bound vehicle for example by means of existing odometric systems, for instance in a radar-based manner or by means of a wheelset pulse generator, in a satellite-based manner and/or taking into account "sampling points", for instance in the form of balises. In addition to the current position and the current speed of the track-bound vehicle, the vehicle data may in principle also include further information or details. The latter may consist for example of details concerning the type of track-bound vehicle, its braking capacity and/or its weight.

The vehicle data may in principle be transmitted from the track-bound vehicle to the stationary control device in any manner known per se. Preferably, however, the vehicle data are transmitted from the track-bound vehicle to the stationary control device wirelessly, i.e. for example in a radio-based manner, at least on a subsection of the communication path.

According to the second step of the inventive method, a strike-in point is determined by the stationary control device taking into account the received vehicle data as well as route data comprising at least the location of the level crossing. At this juncture it should be pointed out that not necessarily all of the data transmitted from the respective track-bound vehicle to the stationary control device are taken into account in the determination of the strike-in point. Thus, within the scope of the present invention, the vehicle data are characterized in that they comprise at least the current position and the current speed of the track-bound vehicle as well as, where applicable, further variables that are taken into account on the part of the stationary control device in the determination of the strike-in point. Insofar as further data are received by the stationary control device from the track-bound vehicle for a different purpose, yet said data are not taken into account in the determination of the strike-in point, then said further data are not vehicle data within the meaning of the present invention.

In addition to the received vehicle data, route data comprising at least the location of the level crossing are taken into account by the stationary control device in the determination of the strike-in point. Furthermore, the route data taken into account may, where applicable, comprise further characteristic variables, such as details concerning the grade, i.e. up-gradient or down-gradient, of the track system, for example.

According to the third step of the inventive method, a securing of the level crossing is triggered by the stationary control device when the strike-in point is reached. This means that the stationary control device acts directly or indirectly on at least one component provided for securing the level crossing in such a way that said component initiates or performs the securing of the level crossing. Depending on the type of means used for securing the level crossing, the latter can be correspondingly secured for example by a switching-on of one or more signal lamps, a closing of railroad crossing barriers or the initiation of another action for securing the level crossing.

The inventive method is characterized in that it incorporates the stationary control device of the train control system into the securing of the level crossing beyond conventional system boundaries. This advantageously enables a communication channel employed in any case by said components for their communication to be used for transmitting the vehicle data from the track-bound vehicle to the stationary control device of the train control system. In addition, it is advantageously possible for the stationary control device of the train control system, in the event of a problem or error in the securing of the level crossing, to act on the track-bound vehicle in such a way that the latter still comes to a stop in good time ahead of the level crossing or else reaches the level crossing at least at a (greatly) reduced speed.

The inventive method is furthermore particularly effective to the extent that it permits the strike-in point to be determined dynamically taking into account at least the current position and the current speed of the track-bound vehicle. This means that in a situation for example in which the track-bound vehicle approaches the level crossing at a comparatively slow speed, a securing of the level crossing is initiated at a later time than in the situation in which the track-bound vehicle approaches the level crossing at a comparatively high speed. Consequently, a securing of the level crossing is triggered neither when a predetermined location is reached nor at a predetermined time. With regard to the strike-in point being calculated dynamically rather than being specified by a component such as a sensor device arranged at a fixed location along the track, the strike-in point may also be referred to as a "virtual" strike-in point.

The inventive method accordingly permits a timely securing of a level crossing in a particularly reliable manner, wherein, depending on the particular circumstances, a closure time of the level crossing can be achieved which is substantially constant irrespective of the speed of the respective track-bound vehicle.

According to a particularly preferred development of the inventive method, a strike-in point in the form of a track waypoint is determined by the stationary control device and a securing of the level crossing is initiated if, according to the received vehicle data, the track-bound vehicle has reached the track waypoint in question. This is advantageous because it is easily possible for the stationary control device to compare the position of the track-bound vehicle with the determined track waypoint on the basis of the received vehicle data, which comprise the current position of the track-bound vehicle, and in the event that the track-bound vehicle has reached the track waypoint in question, to initiate the securing of the level crossing.

In addition or alternatively to the above-described embodiment variant, the inventive method may also be developed in such a way that a strike-in point in the form of a point in time is determined by the stationary control device and the securing of the level crossing is initiated at the respective point in time. It is also advantageously possible to decide on the basis of a strike-in point in the form of a point in time whether a securing of the level crossing is to be triggered already or not. The point in time itself may in this case be specified in absolute terms, i.e. for example by the specification of a time of day, preferably at least with to-the-second precision, or else also indirectly by specification of a time interval after the expiry of which the securing of the level crossing is initiated.

Preferably, the inventive method may also be embodied in such a way that the securing of the level crossing is initiated in that a request to secure the level crossing is transmitted by the stationary control device to an interlocking connected for communication purposes to the level crossing, a securing signal is hereupon transmitted by the interlocking to a local control component of the level crossing, and the securing of the level crossing is initiated by the local control component in response to the reception of the securing signal. This embodiment variant of the inventive method offers the advantage that reliable communication paths which already exist anyway for signaling purposes are often used in this case. Thus, local control components of level crossings, i.e. level crossing controllers for example, are frequently connected for communication or signaling purposes to an interlocking in order to perform control and monitoring functions. Depending on the type of the respective train control system and the respective implementation, the corresponding interlocking is in turn already connected for communication purposes to the stationary control device of the train control system. There is therefore a communication channel available which permits the stationary control device to initiate a securing of the level crossing via the interlocking and the local control component of the level crossing.

According to a further particularly preferred embodiment variant of the inventive method, once the level crossing has been successfully secured, a confirmation signal is transmitted by the local control component to the interlocking and a confirmation relating to the successful securing of the level crossing is hereupon transmitted by the interlocking to the stationary control device. This offers the advantage that the stationary control device receives a confirmation to the effect that the securing of the level crossing initiated by it was successful and consequently the level crossing is in the secured state.

Preferably, the inventive method may furthermore be embodied in this case in such a way that following reception of the confirmation, a track warrant (permission to move) extending beyond the level crossing is determined by the stationary control device and transmitted to the track-bound vehicle as replacement for a previous permission to move ending ahead of the level crossing. This therefore makes it possible for the stationary control device of the train control system, in the event of confirmation of the securing of the level crossing, to act on the track-bound vehicle by transmitting to the latter a permission to move that extends beyond the level crossing. A corresponding permission to move is also referred to as a "movement authority" and in the real-life situation results in the track-bound vehicle not coming to a stop ahead of the level crossing as per the previous movement authority, but being able to pass through the level crossing without stopping.

According to a particularly preferred development of the inventive method, the strike-in point is determined by the stationary control device while additionally taking into account a speed profile that is possible for a further approaching of the track-bound vehicle to the level crossing. This is advantageous because a timely securing of the level crossing must also be ensured in the event of an acceleration of the track-bound vehicle. This happens in the present case in that the speed profile that is possible for the further approaching of the track-bound vehicle to the level crossing is taken into account in addition in the determination of the strike-in point.

Preferably, the inventive method may furthermore be embodied also in such a way that the speed profile that is possible for the further approaching of the track-bound vehicle to the level crossing is determined by the stationary control device based on acceleration curves which take into account the received vehicle data. This means that the acceleration curves used take into account in particular the current location and the current speed of the track-bound vehicle.

According to a further particularly preferred embodiment variant of the inventive method, the strike-in point is determined by the stationary control device taking into account a delay time in the securing of the level crossing. In this case the delay time taken into account preferably comprises all delays that may occur when the securing of the level crossing is performed. This includes for example a barrier operating time, a pre-warning time/crossing clearing time and/or requisite communication and activation times. Taking the delay time into account in a corresponding manner advantageously enables a timely securing of the level crossing to be reliably ensured even under unfavorable conditions.

According to a further particularly preferred embodiment of the inventive method, the vehicle data are received and the strike-in point is determined on a continuous basis. In this case, therefore, the vehicle data are received by the stationary control device at preferably regular time intervals that, depending on the particular requirements, preferably lie in the range of fractions of a second or a few seconds, and the strike-in point is determined anew in each case taking into account said vehicle data and the route data. In this way it is therefore advantageously made possible to respond in a timely manner to any changes in the speed profile of the track-bound vehicle and accordingly to provide an earlier or later strike-in point.

Basically, any desired communication channel or communication path may be used for transmitting the vehicle data received by the stationary control device from the track-bound vehicle. Within the scope of the description of the present invention, the term "communication channel" serves in this context to denote a transmission path or transmission medium, without this actually having to correspond to a "channel" in, for instance, a radio communications sense.

According to a further particularly preferred embodiment variant of the inventive method, a communication channel of the train control system is used for transmitting the vehicle data received by the stationary control device from the track-bound vehicle. Transmitting the vehicle data via the communication channel of the train control system affords the advantage that an already available and at the same time reliable communication channel may be used for transmitting the vehicle data. Accordingly, this avoids in particular additional costs being incurred for providing another communication channel and makes use of existing resources and communication paths in a beneficial and efficient manner.

Preferably, the inventive method may also be embodied in such a way that the strike-in point is checked for validity on the part of the stationary control device based on sensor data acquired by at least one trackside sensor device. If appropriate, the safety and reliability of the method may be increased further by means of a corresponding validity check. In this instance the trackside sensor device may be for example a wheel sensor, wherein the acquired sensor data in this case may for example specify the speed of the track-bound vehicle and at the same time indicate that the track-bound vehicle is currently situated at the location of the trackside sensor device in question.

The present invention further relates to a stationary control device for a train control system.

With regard to the stationary control device, the object underlying the present invention is to disclose a stationary control device for a train control system which supports a method for securing a level crossing, which method permits a timely securing of the respective level crossing and at the same time is particularly effective and reliable.

This object is achieved according to the invention by means of a stationary control device for a train control system, the stationary control device being embodied to receive vehicle data from a track-bound vehicle approaching the level crossing, which vehicle data comprise at least the current position and the current speed of the track-bound vehicle, to determine a strike-in point for the level crossing taking into account the received vehicle data and route data comprising at least the location of the level crossing, and to initiate a securing of the level crossing when the strike-in point is reached.

The advantages of the inventive stationary control device substantially correspond to those of the inventive method, such that reference is made in this regard to the corresponding aforementioned statements.

Preferably, the inventive stationary control device is developed in such a way that it is embodied to implement one of the above-described preferred developments of the inventive method. In order to avoid repetitions, reference shall be made to the corresponding aforementioned statements in connection with the respective developments of the inventive method also in respect of the advantages of this preferred embodiment variant of the stationary control device.

Preferably, the inventive stationary control device may also be developed in such a way that it is a stationary control device of a train control system maintaining continuous communication between the track-bound vehicle and the stationary control device, in particular a stationary control device of a train control system conforming to one of the standards ETCS (European Train Control System), CTCS (Chinese Train Control System) or PTC (Positive Train Control). This embodiment variant of the inventive stationary control device is advantageous to the extent that in particular train control systems maintaining continuous communication between the track-bound vehicles and the stationary control device are suitable for realizing the inventive method and its preferred developments. This therefore relates in particular to train control systems conforming to ETCS Level 2 or 3, CTCS Level 3 or 4 or the American train control system PTC. On account of the high speeds supported, corresponding modern-day train control systems often make no provision at all for level crossings. Thanks to the present invention, however, it is now made possible to ensure reliable and timely protection of level crossings also, and more specifically, in such systems and by this means to achieve a minimization of the closure time of the level crossing in the interests of an optimal "constant warning time".

The present invention further comprises an arrangement having an inventive stationary control device or a stationary control device according to one of the above-described preferred developments of the inventive stationary control device, a local control component of a level crossing, and an interlocking connected for communication purposes to the stationary control device and the local control component of the level crossing.

BRIEF DESCRIPTION OF THE SEVERAL VIEWS OF THE DRAWING

The invention is explained in more detail below with reference to exemplary embodiments and the attached drawings, in which.

DESCRIPTION OF THE INVENTION

For clarity of illustration reasons, like or like-acting components are labeled with the same reference signs in the figures.

Figure 1:
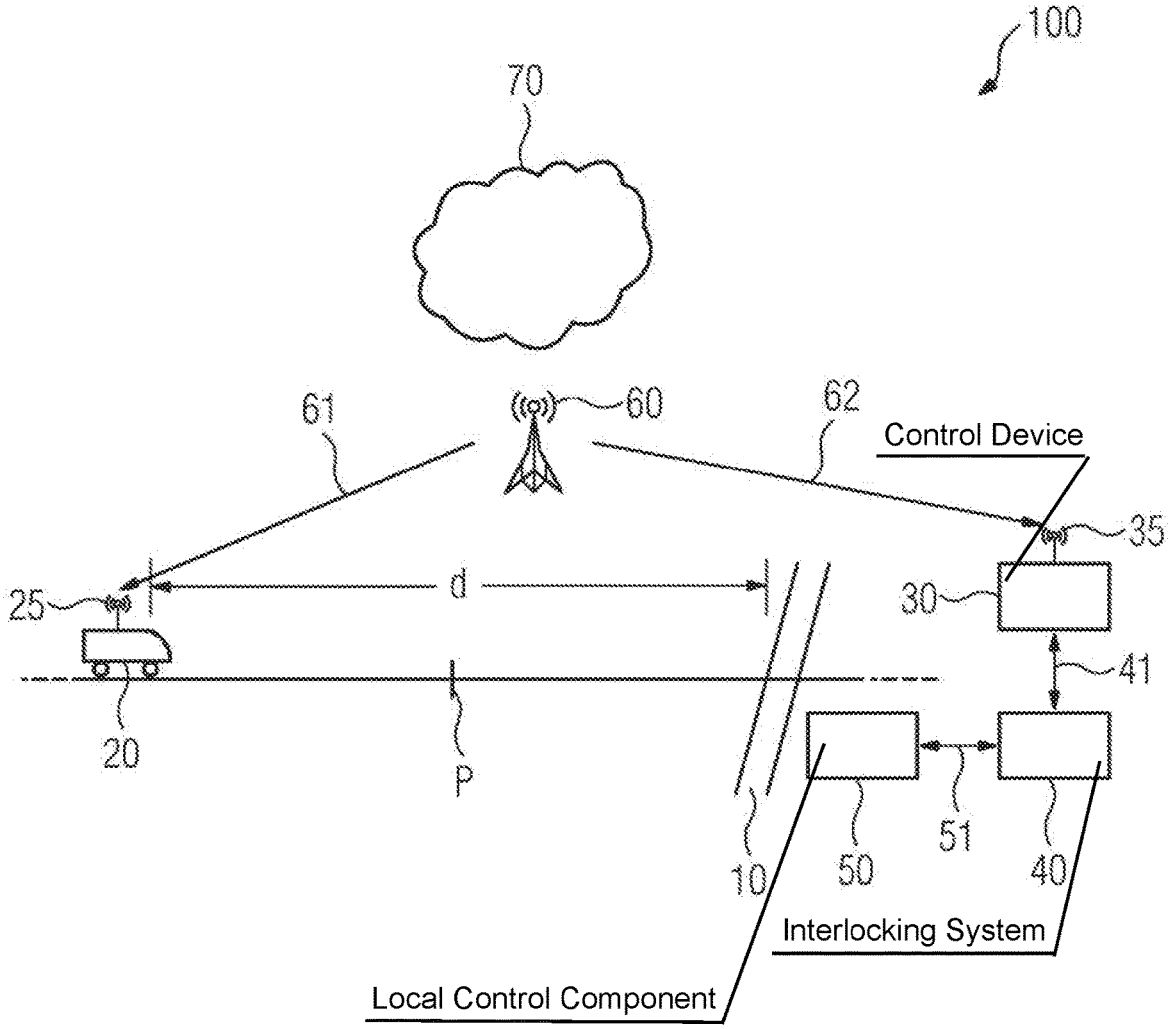
FIG. 1 shows a first exemplary embodiment of an inventive arrangement in a first schematic diagram intended to explain a first exemplary embodiment of the inventive method.

FIG. 1 shows a first exemplary embodiment of an inventive arrangement 100 in a first schematic diagram intended to explain a first exemplary embodiment of the inventive method. In detail, there is indicated therein a level crossing 10 which is approached by a track-bound vehicle 20 coming from the left. The distance between the track-bound vehicle 20 and the level crossing 10 at the point in time illustrated is equal to d.

Also identifiable in the diagram shown in FIG. 1 is a stationary control device 30 of a train control system. Let it be assumed within the scope of the described exemplary embodiment in this case that the stationary control device 30 is a central track control unit in the form of a radio block center (RBC) of a train control system conforming to the ETCS (European Train Control System) Level 2 standard. Also indicated in the diagram shown in FIG. 1 are an interlocking 40 and a local control component 50 of the level crossing 10. The interlocking 40 is connected for communication purposes to the stationary control device 30 on the one hand via a bidirectional communications link 41. On the other hand, the interlocking 40 is also connected for communication or signaling purposes to the local control component 50 of the level crossing 10 via a bidirectional communications link 51.

According to the diagram shown in FIG. 1, a bidirectional communications link also exists between an onboard antenna 25 of the track-bound vehicle 20 and a stationary antenna 35 of the stationary control device 30. Said bidirectional communications link, which may also be referred to as a communication channel, is indicated in the exemplary embodiment shown in FIG. 1 as a wireless, mobile communications link and within the scope of the described exemplary embodiment should be realized by way of the railroad-specific mobile communications network GSM-R (Global System for Mobile Communications-Railway). For this purpose, the indicated mobile communications network labeled with the reference sign 70 has a base station 60 via which bidirectional communication between the track-bound vehicle 20 and the stationary control device 30 is possible by means of hops or communication link sections 61 and 62. In order to avoid misunderstandings it should be pointed out at this juncture that the corresponding communications link may of course also be implemented at least in part as a wired connection. Thus, it is conceivable for example that the stationary control device 30 is connected to the mobile communications network 70 or to the base station 60 of the same in a wired manner, i.e. via a copper or fiber optic cable, for example.

The arrangement shown in FIG. 1 may now be used for example for securing the level crossing 10 in such a way that vehicle data are received by the stationary control device 30 of the train control system from the track-bound vehicle 20 approaching the level crossing 10, which vehicle data comprise at least the current position and the current speed of the track-bound vehicle 20. Taking into account the received vehicle data and route data comprising at least the location of the level crossing 10, it is then possible for the stationary control device 30 to determine a strike-in point. It shall be assumed within the scope of the described exemplary embodiment in this case that the strike-in point is a track waypoint P. Alternatively or, where appropriate, in addition hereto, a point in time could also be used as a strike-in point.

The described method runs on a continuous or permanent basis, with the result that the vehicle data are received by the stationary control device 30 at short time intervals. The strike-in point in the form of the track waypoint P is hereupon determined or recalculated in correspondingly continuous form by the stationary control device 30. As soon as the track-bound vehicle 20 has reached the track waypoint P according to the vehicle data received by the stationary control device, a securing of the level crossing 10 is initiated by the stationary control device 30. It shall be assumed within the scope of the described exemplary embodiment that this happens in that a request to secure the level crossing 10 is transmitted by the stationary control device 30 to the interlocking 40 connected for communication purposes to the level crossing 10 and a securing signal is hereupon transmitted by the interlocking 40 to the local control component 50 of the level crossing 10. The securing of the level crossing 10 is initiated by the local control component 50 in response to the reception of the securing signal. In this case the securing may be accomplished for example in that firstly a visual and/or audible warning signal is issued and thereupon one or more barriers of the level crossing 10 are closed.

Following successful securing of the level crossing 10, i.e. after the barriers have been closed for example without malfunction or fault message and where applicable—provided a corresponding monitoring component is present—it has been checked that the danger zone in the region of the level crossing is clear, a confirmation signal is transmitted by the local control component 50 to the interlocking 40. The latter for its part hereupon transmits a confirmation relating to the successful securing of the level crossing 10 to the stationary control device 30 of the train control system. A reliable acknowledgement is thus available to the stationary control device 30 to the effect that the securing of the level crossing 10 initiated by it has been successfully concluded.

Based on said acknowledgement, the stationary control device 30 now determines a movement authority extending beyond the level crossing 10 and transmits the same to the track-bound vehicle 20 as replacement for a previous movement authority ending ahead of the level crossing 10. This happens once again via the bidirectional communications link 61, 62, with the base station 60 of the mobile communications network 70 being interposed therebetween. A correspondingly upgraded movement authority therefore advantageously avoids the necessity for the track-bound vehicle 20 to be brought a stop or at least to be braked ahead of the level crossing 10 for safety reasons.

Preferably, the communications link 61, 62 between the stationary control device 30 and the track-bound vehicle 20 is monitored on a permanent basis. In the event of a malfunction, the track-bound vehicle 20 in this case assumes a safe state to the effect that it brakes automatically if for example the communications link 61, 62 to the stationary control device 30 goes down or no movement authority arrives within an expected period of time.

According to the aforementioned statements, the described method makes use of the existing safety structure between the interlocking 40 and the level crossing 10 or the local control component 50 of the same. In this case the stationary control device 30 communicates with the interlocking 40 in order to ensure a shortest possible closure time of the level crossing 10 in terms of a "constant warning time" while simultaneously excluding potential hazards. In the process the strike-in point in the form of the track waypoint P is taken into account by the stationary control device 30 preferably while factoring in a (maximum) delay time occurring during the securing of the level crossing 10, which delay time includes for example a barrier operating time, a pre-warning time/crossing clearing time, times required for the communication between components involved, and activation times.

The described method advantageously integrates itself seamlessly into the standard mode of operation of the train control system. Thus, movement authorities are typically determined on the part of the stationary control device 30 on the basis of dynamic and static track-related data. Should the track-bound vehicle 20 need to modify its operating profile due to track conditions, e.g. due to weather, technical problems, track-related problems e.g. in the form of obstacles or persons in the track area, this is registered by the stationary control device 30 as a result of the continuous communication and if necessary an updated movement authority is hereupon generated by the stationary control device 30 and transmitted to the track-bound vehicle 20. Thus, the method for optimizing the protection of the level crossing 10 advantageously uses data which are already used at least in part in connection with the determining of movement authorities in the train control system and consequently ensures a best possible optimization of the closure time of the level crossing 10 for virtually all cases of train movements. For this purpose, the strike-in point P is advantageously calculated dynamically, this therefore being a "virtual" strike-in point that is not at a fixed location, but is adapted to the particular circumstances. Said virtual strike-in point is therefore the track waypoint P, the securing or activation or closure of the level crossing 10 being initiated for the respective track-bound vehicle 20 when said track waypoint P is reached. In this case the movement information received by the stationary control device 30 is used in order to determine exactly at each point in time, while taking into account the current speed profile of the track-bound vehicle 20 and the speed profile possible for its continued movement, the distance of the track-bound vehicle from the level crossing 10 or, as the case may be, the time still remaining until the level crossing 10 is reached and, based thereon, the point in time for initiating the securing of the level crossing 10. Preferably, the strike-in point in the form of the track waypoint P or in the form of the point in time is determined in this case by the stationary control device 30 while additionally taking into account a speed profile possible for a further approaching of the track-bound vehicle 20 to the level crossing 10. In this case the speed profile possible for the further approaching of the track-bound vehicle to the level crossing 10 can be determined by the stationary control device 30 based on acceleration curves which take into account the received vehicle data.

Figure 2:
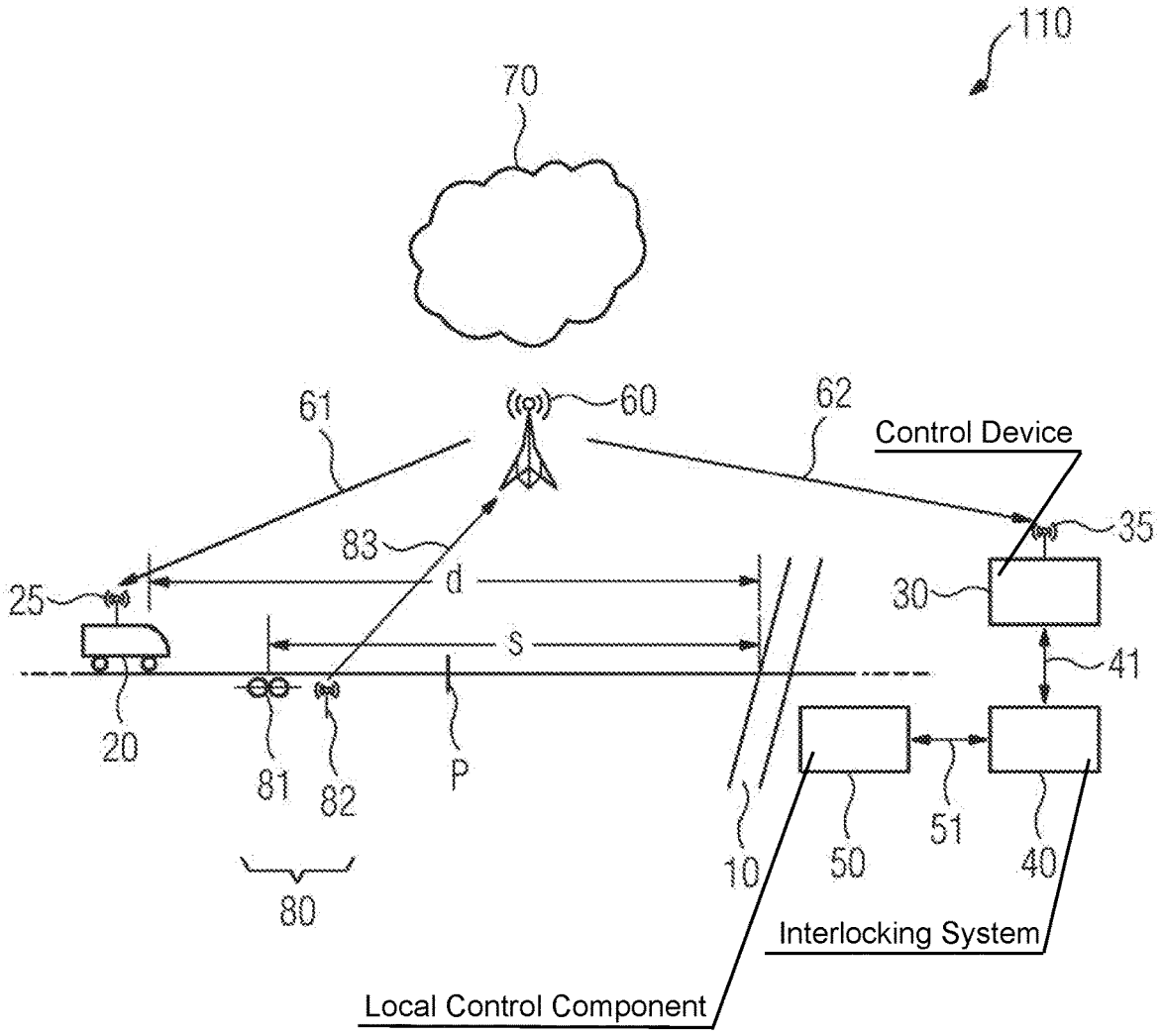
FIG. 2 shows a second exemplary embodiment of an inventive arrangement in a second schematic diagram intended to explain a second exemplary embodiment of the inventive method.

FIG. 2 shows a second exemplary embodiment of an inventive arrangement 110 in a second schematic diagram intended to explain a second exemplary embodiment of the inventive method.

The arrangement shown in FIG. 2 substantially corresponds to that shown in FIG. 1. Additionally identifiable in FIG. 2, however, is a trackside sensor device 80 which, within the scope of the illustrated exemplary embodiment, is a radio-operated approach annunciator arranged at a distance s ahead of the level crossing 10. The trackside sensor device 80 comprises a wheel sensor 81 and a radio module 82 via which the trackside sensor device 80 is able to set up a communications link 83 to the stationary control device 30 by way of the mobile communications network 70 or the base station 60 of the same (or, as the case may be, a different base station of the mobile communications network 70) and also transfer data to said stationary control device 30. In the exemplary embodiment of FIG. 2, the communications link 83 is realized as a unidirectional connection; alternatively hereto, this could of course likewise be a bidirectional communications link.

Preferably, the trackside sensor device 80 in the form of the radio-operated approach annunciator or the wheel sensor 81 of the same determines the speed of the track-bound vehicle 20 and transmits this to the stationary control device 30 together with the information that the track-bound vehicle 20 (or a track-bound vehicle generally) has been detected and is therefore positioned precisely at the location of the radio-operated approach annunciator 80.

This advantageously makes it possible for the stationary control device 30 to check the validity of the determined strike-in point in the form of the track waypoint P based on the sensor data acquired by the trackside sensor device 80 in the form of the radio-operated approach annunciator, i.e. for example to conduct a check on the vehicle data received from the track-bound vehicle 20, in particular the current position and the current speed. If this results in discrepancies or if errors are detected, the possibility advantageously exists on the part of the stationary control device 30 to initiate a braking action of the track-bound vehicle 20, e.g. by transmission of a correspondingly restricted movement authority. Furthermore, the trackside sensor device 80 in the form of the radio-operated approach annunciator may advantageously also be used for such track-bound vehicles that are not able to communicate bidirectionally with the stationary control device 30 of the train control system. In this way a kind of "mixed mode operation" is therefore also made possible between such track-bound vehicles 20, which for example comprise a corresponding ETCS onboard device, and other vehicles, e.g. in the form of maintenance vehicles.

According to the aforementioned statements in connection with the described exemplary embodiments of the inventive method, the inventive stationary control device and the inventive arrangement, these possess in particular the advantage that they enable the level crossing 10 to be secured in a particularly effective and reliable way. In the process, by taking into account in particular the current position and the current speed of the track-bound vehicle 20, it is possible to avoid an unnecessarily long closure time of the level crossing 10 and to achieve a substantially consistent closure time. At the same time, potential risks due to a securing of the level crossing 10 being initiated too late or due to a malfunction during the execution of the same are reliably excluded in particular as a result of the continuous communication between the stationary control device 30 and the track-bound vehicle 20. During this operation, furthermore, use is advantageously made of a communication channel of the train control system which the latter possesses in any case and which enables a continuous communication between the track-bound vehicle 20 and the stationary control device 30. Accordingly, the described approach is advantageous in particular in connection with the train control systems ETCS Level 2 and 3, CTCS Level 3 and 4, and PTC.

The invention claimed is:

1. A method for securing a level crossing, the method comprising the following steps:

using a stationary control device of a train control system for:

receiving vehicle data from a track-bound vehicle approaching the level crossing and including at least a current position and a current speed of the track-bound vehicle in the vehicle data;

determining a strike-in point by taking the received vehicle data and route data including at least a location of the level crossing into account; and initiating a securing of the level crossing upon reaching the strike-in point.

2. The method according to claim 1, which further comprises using the stationary control device for:

determining a track waypoint as the strike-in point; and initiating the securing of the level crossing if, according to the received vehicle data, the track-bound vehicle has reached the track waypoint.

3. The method according to claim 1, which further comprises using the stationary control device for:

determining a point in time as the strike-in point; and initiating the securing of the level crossing at the point in time.

4. The method according to claim 1, which further comprises:

initiating the securing of the level crossing by transmitting a request to secure the level crossing from the stationary control device to an interlocking system connected for communication to the level crossing;

then transmitting a securing signal from the interlocking system to a local control component of the level crossing; and initiating the securing of the level crossing by the local control component in response to receiving the securing signal.

5. The method according to claim 4, which further comprises following a successful securing of the level crossing:

transmitting a confirmation signal from the local control component to the interlocking system; and then transmitting a confirmation relating to the successful securing of the level crossing from the interlocking system to the stationary control device.

6. The method according to claim 5, which further comprises following a reception of the confirmation, using the stationary control device to determine a movement authority extending beyond the level crossing and transmitting the movement authority to the track-bound vehicle as a replacement for a previous movement authority ending ahead of the level crossing.

7. The method according to claim 1, which further comprises using the stationary control device to determine the strike-in point while additionally taking a possible speed profile for a further approach of the track-bound vehicle to the level crossing into account.

8. The method according to claim 7, which further comprises using the stationary control device to determine the possible speed profile for the further approach of the track-bound vehicle to the level crossing based on acceleration curves taking the received vehicle data into account.

9. The method according to claim 1, which further comprises using the stationary control device to determine the strike-in point while taking a delay time in the securing of the level crossing into account.

10. The method according to claim 1, which further comprises receiving the vehicle data and determining the strike-in point on a continuous basis.

11. The method according to claim 1, which further comprises using a communication channel of the train control system for transmitting the vehicle data from the track-bound vehicle to the stationary control device.

12. The method according to claim 1, which further comprises using the stationary control device to check the strike-in point for validity based on sensor data acquired by at least one trackside sensor device.

13. A stationary control device for a train control system, the stationary control device being configured:

to receive vehicle data from a track-bound vehicle approaching a level crossing, the vehicle data including at least a current position and a current speed of the track-bound vehicle;

to determine a strike-in point for the level crossing taking into account the received vehicle data and route data including at least a location of the level crossing; and to initiate a securing of the level crossing upon reaching the strike-in point.

14. The stationary control device according to claim 13, wherein the stationary control device is configured:

to determine a track waypoint as the strike-in point; and to initiate the securing of the level crossing if, according to the received vehicle data, the track-bound vehicle has reached the track waypoint.

15. The stationary control device according to claim 14, wherein the train control system conforms to one of the ETCS (European Train Control System), CTCS (Chinese Train Control System) or PTC (Positive Train Control) standards.

16. The stationary control device according to claim 13, wherein the stationary control device is part of a train control system maintaining continuous communication between the track-bound vehicle and the stationary control device.

17. An arrangement, comprising:

a stationary control device according to claim 13;

a local control component of a level crossing; and an interlocking system connected for communication to the stationary control device and to the local control component of the level crossing.

* * * * *